US007743889B2

(12) United States Patent
Kawai

(10) Patent No.: US 7,743,889 B2
(45) Date of Patent: Jun. 29, 2010

(54) ELEVATOR CONTROL SYSTEM WHICH OPERATES AN ELEVATOR IN AN EVENT OF A FIRE

(75) Inventor: Kiyoji Kawai, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 492 days.

(21) Appl. No.: 11/791,018

(22) PCT Filed: Jan. 20, 2006

(86) PCT No.: PCT/JP2006/000825

§ 371 (c)(1),
(2), (4) Date: May 18, 2007

(87) PCT Pub. No.: WO2007/083383

PCT Pub. Date: Jul. 26, 2007

(65) Prior Publication Data

US 2009/0255761 A1 Oct. 15, 2009

(51) Int. Cl.
*B66B 13/02* (2006.01)

(52) U.S. Cl. ..... 187/313; 187/393; 187/384

(58) Field of Classification Search ..... 187/247, 187/248, 313, 316, 317, 380–388, 391–393
See application file for complete search history.

(56) References Cited

U.S. PATENT DOCUMENTS 4,023,146 A * 5/1977 Carroll ..... 710/113
5,979,607 A * 11/1999 Allen ..... 187/390
7,182,174 B2 * 2/2007 Parrini et al. ..... 182/18
7,210,564 B2 * 5/2007 Kawai ..... 187/384
2004/0163325 A1 8/2004 Parrini et al.

FOREIGN PATENT DOCUMENTS

| | | |
|---|---|---|
| CN | 1509974 | 7/2004 |
| JP | 52 106550 | 9/1977 |
| JP | 58 52171 | 3/1983 |
| JP | 5 8954 | 1/1993 |
| JP | 2002 509850 | 4/2002 |
| JP | 2002-509850 | 4/2002 |
| JP | 2005-187162 | 7/2005 |
| JP | 2005 187162 | 7/2005 |
| WO | 2004 101418 | 11/2004 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

An elevator control system is equipped with an evacuation operation control portion. In the event of a fire, the evacuation operation control portion determines, based on information on the fire and an elevator, whether or not the evacuation operation of the elevator can be performed. When it is determined that the evacuation operation can be performed, the evacuation operation control portion outputs a command to perform the evacuation operation to an elevator control device. Further, a condition for determining whether or not the evacuation operation can be performed is set in the evacuation operation control portion.

13 Claims, 5 Drawing Sheets

ELEVATOR CONTROL SYSTEM WHICH OPERATES AN ELEVATOR IN AN EVENT OF A FIRE

TECHNICAL FIELD

The present invention relates to an elevator control system for performing evacuation operation control for an elevator in an event of a fire in a building.

BACKGROUND ART

In a conventional elevator control system, when a fire occurs in a building, the operation of an elevator is stopped after a car thereof has been moved to an evacuation floor. In recent buildings, however, fire-preventing separation technologies and the like have been improved. Therefore, floors other than a fire occurrence floor and a floor immediately thereabove are virtually immune to the fire, so the operation of the elevator can be continued. Thus, an elevator for evacuation has been proposed to perform rescue operation between a fire occurrence floor and an evacuation floor in the event of a fire (e.g., see JP 06-16357).

Patent Document 1: JP 06-16357 A

DISCLOSURE OF THE INVENTION

Problems to be Solved by the Invention

In the conventional elevator control system as described above, the evacuation operation of the elevator is started after a supervisor has confirmed the states of the fire and the elevator, so it takes a time before the evacuation operation is started. Even during the evacuation operation, the supervisor is required to keep confirming the states, and hence it takes a great deal of trouble.

The present invention has been made to solve the above-mentioned problems, and it is therefore an object of the present invention to provide an elevator control system capable of determining efficiently whether or not the evacuation operation can be performed.

Means for Solving the Problems

An elevator control system according to the present invention includes: an evacuation operation control portion for determining, in an event of a fire, whether or not the evacuation operation of the elevator can be performed based on information on the fire and an elevator, and outputting a command to the perform the evacuation operation to an elevator control device when it is determined that the evacuation operation can be performed.

BEST MODE FOR CARRYING OUT THE INVENTION

A preferred embodiment of the present invention will be described hereinafter with reference to the drawings.

Embodiment 1

Figure 1:
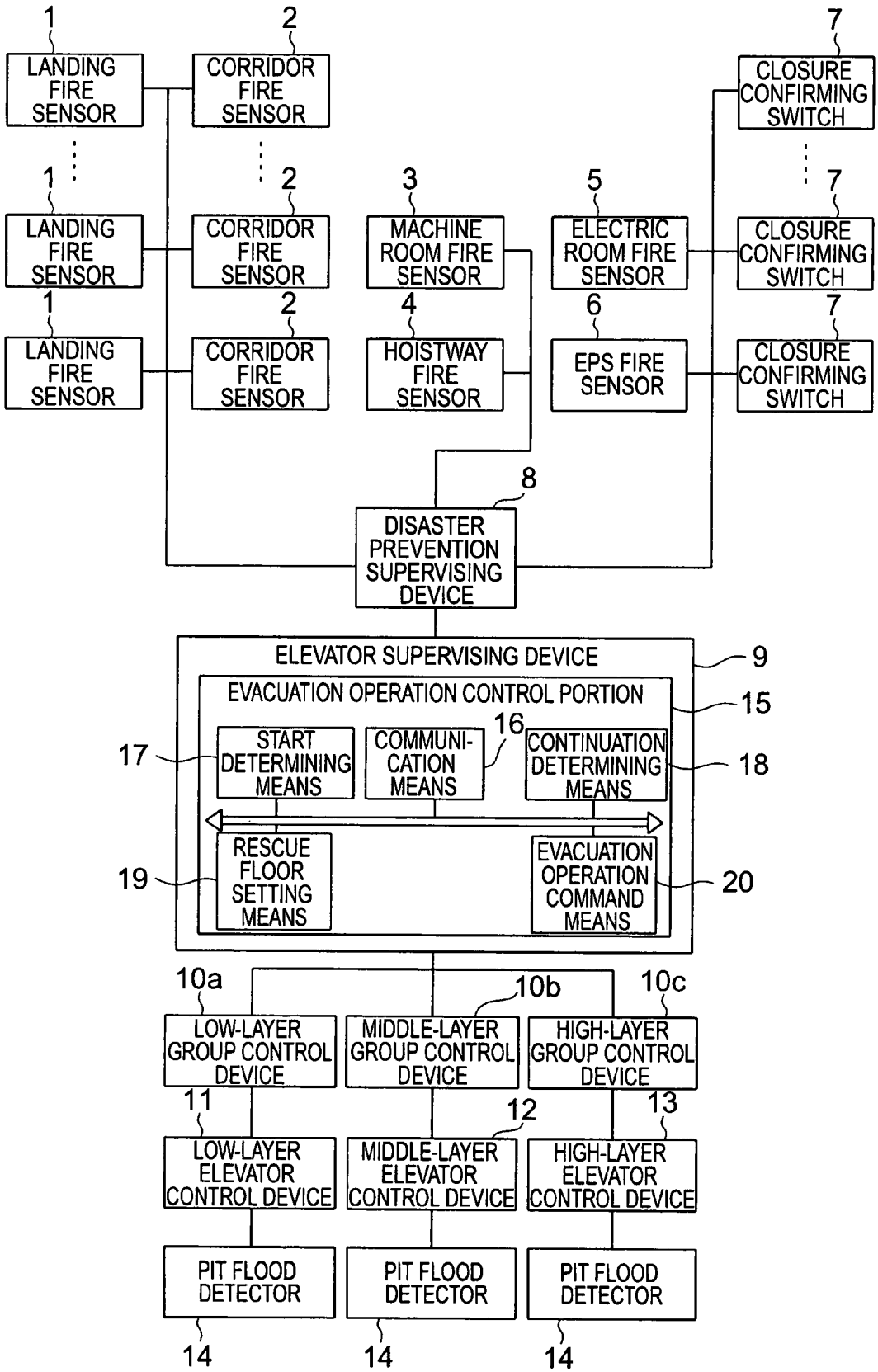
FIG. 1 is a block diagram showing an elevator control system according to Embodiment 1 of the present invention.

FIG. 1 is a block diagram showing an elevator control system according to Embodiment 1 of the present invention. A large number of fire sensors are installed in a building. Examples thereof include landing fire sensors 1 installed at elevator landings (passenger lobbies), corridor fire sensors 2 installed in corridors adjacent to the elevator landings, a machine room fire sensor 3 installed in elevator machine rooms, a hoistway fire sensor 4 installed in elevator hoistway, an electric room fire sensor 5 installed in electric rooms, and an EPS fire sensor 6 installed in electric pipe space (EPS) for cable wirings.

The elevator landing on each of floors is provided with a plurality of fire-preventing doors for shutting the elevator landing off from a surrounding area thereof for reasons of fire prevention. The fire-preventing doors are provided with closure confirming switches 7 for detecting the closure thereof, respectively.

A disaster prevention center in the building is provided with a disaster prevention supervising device 8 and an elevator supervising device 9. Signals from the fire sensors 1 to 6 and the closure confirming switches 7 are input to the disaster prevention supervising device 8. The disaster prevention supervising device 8 identifies a fire occurrence floor based on the signals from the fire sensors 1 to 6, and automatically closes the fire-preventing doors at the elevator landings on the fire occurrence floor and the floors thereabove so as to prevent smoke from entering a corresponding one of the hoistways from the fire occurrence floor.

The elevator supervising device 9 is connected to the disaster prevention supervising device 8. The elevator supervising device 9 controls group control devices 10*a* to 10*c* based on information from the disaster prevention supervising device 8. Each of the group control devices 10*a* to 10*c* controls a plurality of corresponding ones of control devices, namely, low-layer elevator control devices 11, middle-layer elevator control devices 12, or high-layer elevator control devices 13 (only one of the low-layer elevator control devices 11, one of the middle-layer elevator control devices 12, and one of the high-layer elevator control devices 13 are shown in FIG. 1). Installed in pits of the elevators are pit flood detectors 14 for detecting flood in the pits, respectively. Signals from the pit flood detectors 14 are input to the elevator supervising device 9 via the elevator control devices 11 to 13 and the group control devices 10*a* to 10*c*.

The elevator supervising device 9 is constituted by a microcomputer. The elevator supervising device 9 has an evacuation operation control portion 15 for performing evacuation operation by the elevators in the event of a fire. The evacuation operation control portion 15 has communication means 16, start determining means 17, continuation determining means 18, rescue floor setting means (evacuation plan devising means) 19, and evacuation operation command means 20.

The functions of the respective means 16 to 20 are realized by the microcomputer constituting the elevator supervising device 9. That is, programs for realizing the functions of the respective means 16 to 20 are stored in the microcomputer.

The communication means 16 is designed to communicate with the outside. The start determining means 17 determines, based on information on the fire and the elevators, whether or not the evacuation operation can be started. A start condition for determining whether or not the evacuation operation can be started is set in the evacuation operation control portion 15.

The continuation determining means 18 determines, based on information on the fire and the elevators, whether or not the evacuation operation can be continued. A continuation condition for determining whether or not the evacuation operation can be continued is set in the evacuation operation control portion 15.

The rescue floor setting means 19 sets a method of evacuation operation in accordance with a state of the fire. More specifically, based on information transmitted from the disaster prevention supervising device 8 to identify a fire occurrence floor, the rescue floor setting means 19 sets rescue floors, determines the fire-preventing doors to be closed, and generates closure commands.

When the start determining means 17 and the continuation determining means 18 determine that the evacuation operation can be performed, the evacuation operation command means 20 outputs an operation command to each of the group control devices 10*a* to 10*c* based on an evacuation plan created by the rescue floor setting means 19. When the start determining means 17 or the continuation determining means 18 determines that the evacuation operation cannot be performed, the evacuation operation command means 20 outputs a command to suspend the evacuation operation to each of the group control devices 10*a* to 10 *c*.

The disaster prevention supervising device 8, the group control devices 10*a* to 10*c*, and the elevator control devices 11 to 13 are also constituted by computers that are independent of one another.

Now, the following conditions can be exemplified as conditions for starting evacuation operation and conditions for continuing the evacuation operation.

(1) The landing fire sensors 1 on all service floors have not detected a fire. In other words, even if a fire is detected at only one of the elevator landings on the service floors, the evacuation operation is not performed by a corresponding one of the elevators.

(2) The corridor fire sensors 2 on all the service floors have not detected a fire.

(3) The machine room fire sensor 3 and the hoistway fire sensor 4 have not detected a fire.

(4) The fire sensors on the rescue floors and the floors immediately therebelow have not detected a fire.

(5) The electric room fire sensor 5 and the EPS fire sensor 6 have not detected a fire.

(6) It is confirmed that the fire-preventing doors (smoke penetration preventing devices) on a fire occurrence floor and a floor immediately thereabove are in normal operation.

(7) It is confirmed that fire emergency operation has been performed immediately after the occurrence of a fire.

(8) The pit flood detectors 14 have not detected flood.

The conditions for starting the evacuation operation and the conditions for continuing the evacuation operation can be set such that the evacuation operation is permitted when all the conditions (1) to (8) are satisfied. The conditions for starting the evacuation operation and the conditions for continuing the evacuation operation can also be set such that the evacuation operation is permitted when a selected one or a plurality of selected ones of the conditions (1) to (8) are satisfied.

Figure 2:
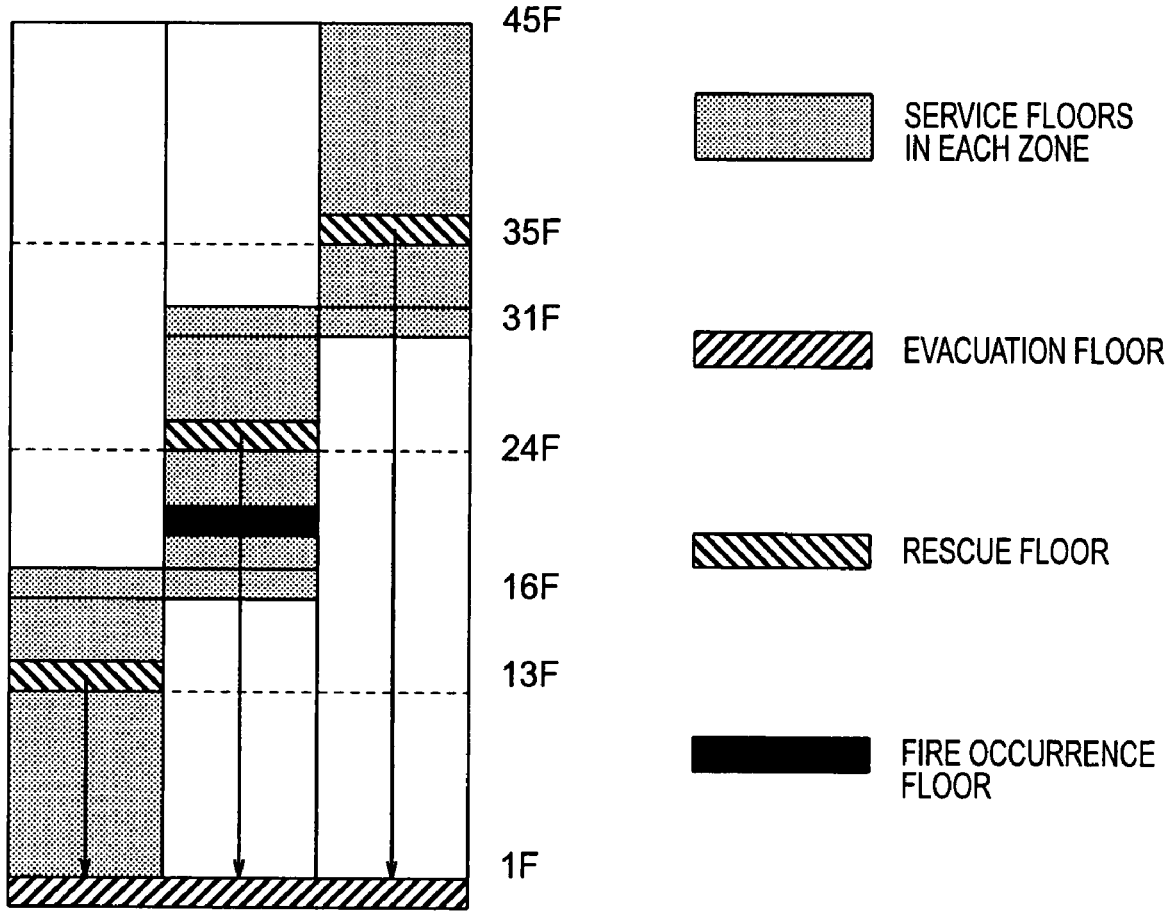
FIG. 2 is an explanatory diagram showing an example of a method of setting rescue floors by rescue floor setting means of FIG. 1.

Next, FIG. 2 is an explanatory diagram showing an example of a method of setting rescue floors by the rescue floor setting means 19 of FIG. 1. Referring to FIG. 2, the service floors for the low-layer elevator are the first to sixteenth floors. The service floors for the middle-layer elevator are the sixteenth to thirty-first floors and the first floor. The service floors for the high-layer elevator are the thirty-first to forty-fifth floors and the first floor.

In the example of FIG. 2, a fire occurs on one of the service floors for the middle-layer elevator. The rescue floor is set to the thirteenth floor during the evacuation operation by the low-layer elevator; the twenty-fourth floor, by the middle-layer elevator; and the thirty-fifth floor, by the high-layer elevator. The evacuation floor is set to the first floor during the evacuation operation by all the elevators. After having escaped to each of the rescue floors taking stairs, a user can escape from the rescue floor to the evacuation floor using a corresponding one of the elevators.

Figure 3:
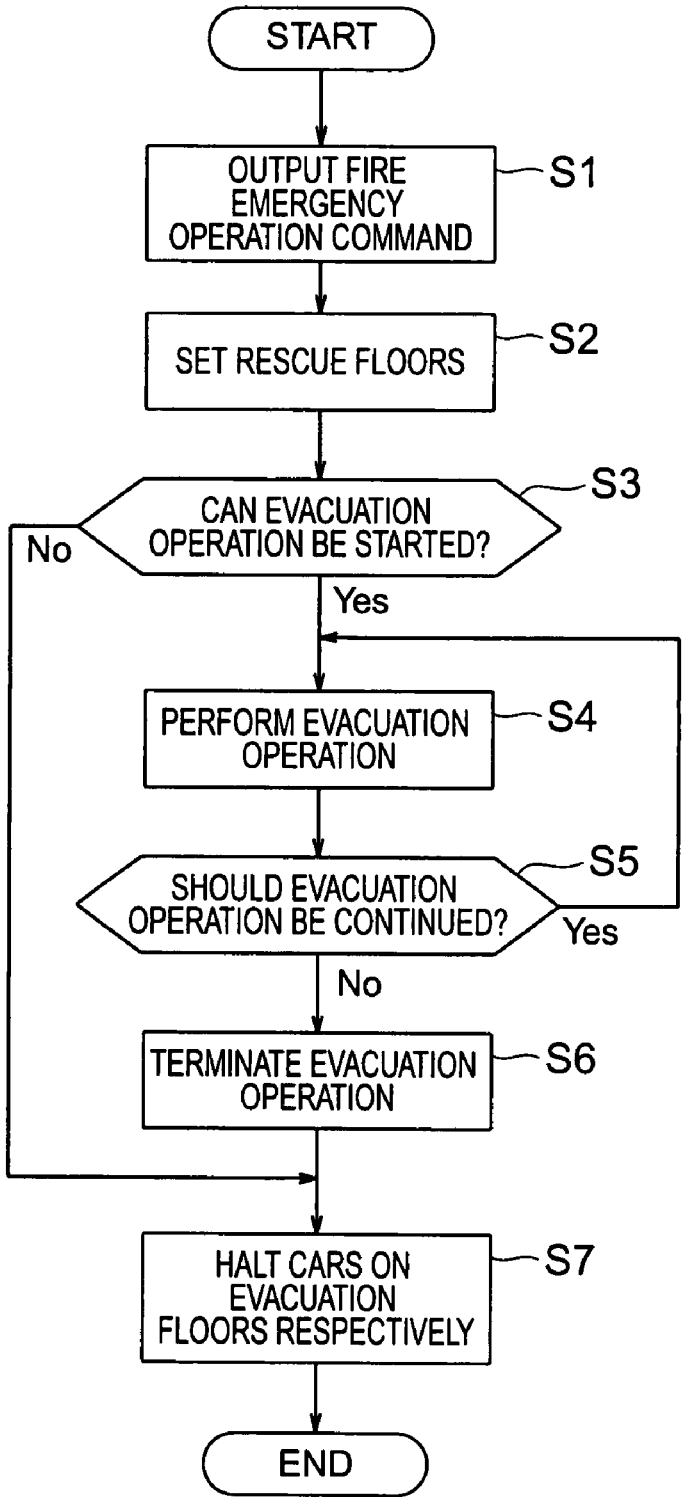
FIG. 3 is a flowchart showing the operation of an evacuation operation control portion of FIG. 1 in the event of a fire.

FIG. 3 is a flowchart showing the operation of the evacuation operation control portion 15 of FIG. 1 in the event of a fire. When the disaster prevention supervising device 8 has confirmed the fire, information on the confirmation of the fire is input to the evacuation operation control portion 15. Thus, the evacuation operation control portion 15 outputs a command to perform fire emergency operation as to all the elevators (Step S1). In fire emergency operation, the car of each of the elevators is homed on to and halted on the evacuation floor.

Upon receiving the information on the confirmation of the fire, the evacuation operation control portion 15 sets the rescue floors (Step S2). After having output the command to perform fire emergency operation and set the rescue floors, the evacuation operation control portion 15 determines, based on the conditions for starting the evacuation operation as described above, whether or not the evacuation operation can be started by the elevators (Step S3). When the evacuation operation cannot be started, the evacuation operation control portion 15 terminates a processing thereof while keeping the cars of all the elevators halted on the evacuation floor (Step S7).

When the evacuation operation can be started, the evacuation operation control portion 15 performs the evacuation operation (Step S4). During the performance of the evacuation operation, the evacuation operation control portion 15 repeatedly determines whether or not the evacuation operation should be continued (Step S5). Then, when it is determined that the evacuation operation should not be continued, the evacuation operation control portion 15 terminates the evacuation operation (Step S6) and homes all the cars on to the evacuation floor (Step S7), thereby terminating the processing.

Figure 4:
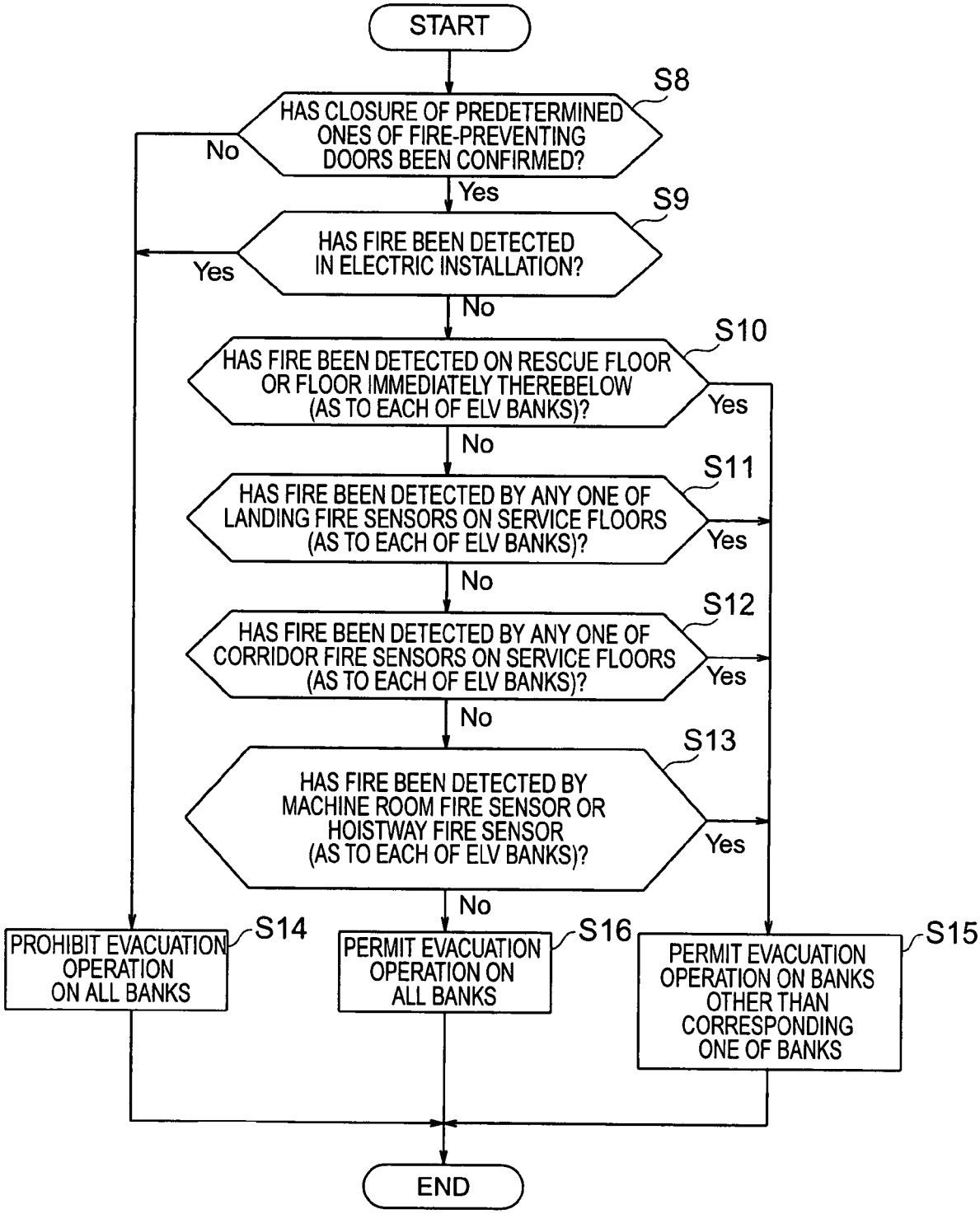
FIG. 4 is a flowchart showing an example of the operation of start determining means of FIG. 1.

FIG. 4 is a flowchart showing an example of the operation of the start determining means 17 of FIG. 1. This flowchart shows a concrete example of the operation in Step S3 of FIG. 3. The start determining means 17 first determines, based on signals from the closure confirming switches 7, whether or not predetermined ones of the fire-preventing doors, namely, the fire-preventing doors at the elevator landings on the fire occurrence floor and the floor immediately thereabove have been closed (Step S8). When the closure of these fire-preventing doors cannot be confirmed, the start determining means 17 determines that the evacuation operation of the elevators on all banks cannot be performed (Step S14).

The start determining means 17 also determines, based on signals from the electric room fire sensors 5 and the EPS fire sensors 6, whether or not a fire has been detected in an electric installation (Step S9). Even when the fire has been detected only in a part of the electric installation, the start determining means 17 determines that the evacuation operation of the elevators on all the banks cannot be performed (Step S14).

Further, the start determining means 17 determines, based on signals from the fire sensors on the respective floors, whether or not a fire has been detected somewhere on the rescue floor or the floor immediately therebelow, as to each of the elevator banks (Step S10). When the fire has been detected on the rescue floor or the floor immediately therebelow, the start determining means 17 determines that the evacuation operation of the elevator on a corresponding one of the banks cannot be performed.

Still further, the start determining means 17 determines whether or not a fire has been detected by any one of the landing fire sensors 1 on the service floors, as to each of the elevator banks (Step S11). When the fire has been detected by any one of the landing fire sensors 1 on the service floors, the start determining means 17 determines that the evacuation operation of the elevator on a corresponding one of the banks cannot be performed.

Moreover, the start determining means 17 determines whether or not a fire has been detected by any one of the corridor fire sensors 2 on the service floors, as to each of the elevator banks (Step S12). When the fire is detected by any one of the corridor fire sensors 2 on the service floors, the start determining means 17 determines that the evacuation operation of the elevator on a corresponding one of the banks cannot be performed.

In addition, the start determining means 17 determines whether or not a fire has been detected by the machine room fire sensor 3 or the hoistway fire sensor 4, as to each of the elevator banks (Step S13). When the fire is detected by the machine room fire sensor 3 or the hoistway fire sensor 4, the start determining means 17 determines that the evacuation operation of the elevator on a corresponding one of the banks cannot be performed.

When the fire is detected in any one of the foregoing determinations made as to each of the elevator banks (Steps S10 to S13), the start determining means 17 determines that only the evacuation operation of the elevators other than the elevator on a corresponding one of the banks can be performed (Step S15). Only when all the determination conditions (Steps S8 to S13) are satisfied, the start determining means 17 determines that the evacuation operation of the elevators on all the banks can be performed (Step S16).

Figure 5:
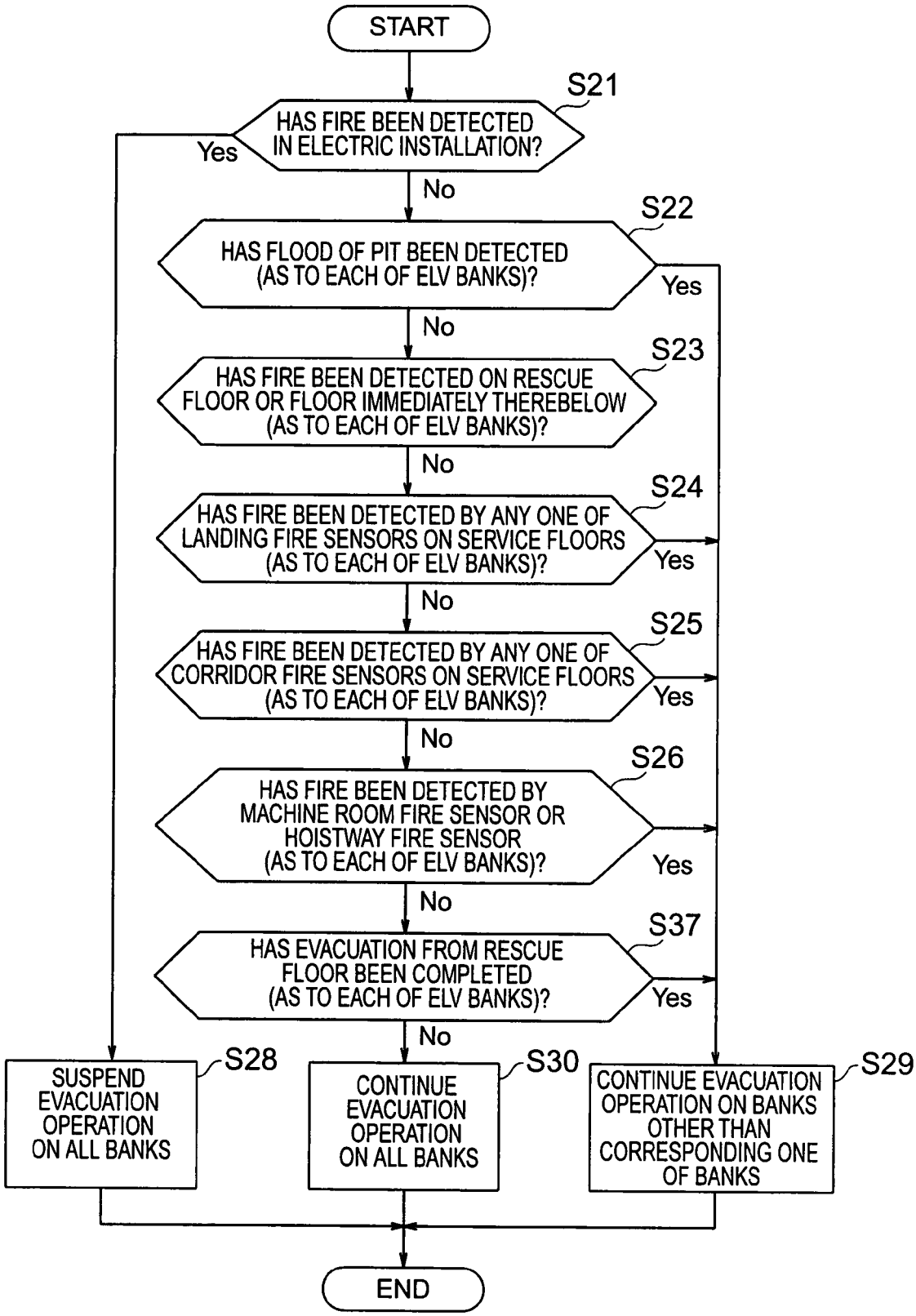
FIG. 5 is a flowchart showing an example of the operation of continuation determining means of FIG. 1.

FIG. 5 is a flowchart showing an example of the operation of the continuation determining means 18 of FIG. 1. This flowchart shows a concrete example of the operation in Step S5 of FIG. 3. The continuation determining means 18 determines, based on signals from the electric room fire sensors 5 and the EPS fire sensors 6, whether or not a fire has been detected in the electric installation (Step S21). Even when the fire is detected only in a part of the electric installation, the continuation determining means 18 determines that the evacuation operation of the elevators on all the banks cannot be performed (Step S28).

The continuation determining means 18 also determines, based on signals from the pit flood detectors 14, whether or not the pit has been flooded, as to each of the elevator banks (Step S22). When flood of any one of the pits is detected, the continuation determining means 18 determines that the evacuation operation of the elevator on a corresponding one of the banks cannot be continued.

Further, the continuation determining means 18 determines, based on signals from the fire sensors on the respective floors, whether or not a fire has been detected somewhere on the rescue floor or the floor immediately therebelow, as to each of the elevator banks (Step S23). When the fire is detected on the rescue floor or the floor immediately therebelow, the continuation determining means 18 determines that the evacuation operation of the elevator on a corresponding one of the banks cannot be continued.

Still further, the continuation determining means 18 determines whether or not a fire has been detected by any one of the landing fire sensors 1 on the service floors, as to each of the elevator banks (Step S24). When the fire is detected by any one of the landing fire sensors 1, the continuation determining means 18 determines that the evacuation operation of the elevator on a corresponding one of the banks cannot be continued.

Moreover, the continuation determining means 18 determines whether or not a fire has been detected by any one of the corridor fire sensors 2 on the service floors, as to each of the elevator banks (Step S25). When the fire is detected by anyone of the corridor fire sensors 2 on the service floors, the continuation determining means 18 determines that the evacuation operation of the elevator on a corresponding one of the banks cannot be continued.

In addition, the continuation determining means 18 determines whether or not a fire has been detected by the machine room fire sensor 3 or the hoistway fire sensor 4, as to each of the elevator banks (Step S26). When the fire is detected by the machine room fire sensor 3 or the hoistway fire sensor 4, the continuation determining means 18 determines that the evacuation operation of the elevator on a corresponding one of the banks cannot be continued.

Further, the continuation determining means 18 determines whether or not evacuation from the rescue floor has been completed, as to each of the elevator banks (Step S27). When it is determined that evacuation from the rescue floor has been completed, the continuation determining means 18 determines that the evacuation operation of the elevator on a corresponding one of the banks cannot (need not) be continued.

When it is determined in any one of the foregoing determinations made as to each of the elevator banks (Steps S22 to S27) that the evacuation operation cannot be performed, the continuation determining means 18 determines that only the evacuation operation of the elevators other than the elevator on a corresponding one of the banks should be continued (Step S29). Only when all the determination conditions (Steps S21 to S26) are satisfied and evacuation from the rescue floors has not been completed as to the elevators on all the banks, the continuation determining means 18 determines that the evacuation operation should be continued by the elevators on all the banks (Step S30).

In the elevator control system configured as described above, the evacuation operation control portion 15 determines, based on information on a fire and the elevators, whether or not the evacuation operation can be performed. When it is determined that the evacuation operation can be performed, the evacuation operation control portion 15 outputs a command to perform the evacuation operation to each of the group control devices 10*a* to 10*c*. It is therefore possible to determine efficiently whether or not the evacuation operation can be performed.

The conditions for starting the evacuation operation and the conditions for continuing the evacuation operation are set respectively in the evacuation operation control portion 15. It is therefore possible to determine efficiently, before the start of the evacuation operation and during the performance of the evacuation operation, whether or not the evacuation operation can be performed.

In the foregoing example, the evacuation operation of the elevators is terminated according to a sequence of the determinations confirming the completion of evacuation from the rescue floors. However, the evacuation operation may be terminated when extinction of the fire is detected.

In the foregoing example, the evacuation operation is prohibited when a fire is detected on the rescue floor or the floor immediately therebelow. However, the evacuation operation may be prohibited when, in addition to the aforementioned condition, a fire is detected on the floor located two floors below the rescue floor.

Further, in the foregoing example, the evacuation operation is permitted after it has been confirmed that the fire preventing doors on the fire occurrence floor and the floor immediately thereabove are in normal operation. However, the evacuation operation may be permitted after it has been confirmed, in addition to the aforementioned condition, that the fire-preventing doors on the floor located two floors above the fire occurrence floor are in normal operation.

Still further, the conditions for determining whether or not the evacuation operation can be performed should not be limited to the foregoing example. For example, a determination on whether or not a power supply capacity required for operation of the elevators is secured may be added to the conditions for determining whether or not the evacuation operation can be performed.

The aforementioned fire-preventing doors are devices for shutting off flames or smoke caused by a fire. For example, the fire-preventing doors include fire shutters and the like.

Moreover, in the foregoing example, signals are transmitted between the elevator supervising device 9 and the components installed in the building via the disaster prevention supervising device 8. However, the signals may be transmitted directly, that is, without the intervention of the disaster prevention supervising device 8.

Further, in the foregoing example, the functions of the evacuation operation control portion 15 are realized by the single computer. However, the functions of the evacuation operation control portion 15 may be allocated to and performed by a plurality of computers. The evacuation operation control portion 15 may be provided in, for example, the disaster prevention supervising device or one of the group control devices 10*a* to 10*c* instead of being provided in the elevator supervising device 9.

Still further, the contents of the evacuation operation plan should not be limited to the foregoing example but may be subjected to various modifications according to the structure of the building, the arrangement of the elevators, and the like. For example, the evacuation floor should not be limited to a hall floor.

The invention claimed is:

1. An elevator control system comprising:

an evacuation operation control portion for determining, in an event of a fire, whether or not evacuation operation of the elevator can be performed based on information on the fire and an elevator, and outputting a command to perform the evacuation operation to an elevator control device when it is determined that the evacuation operation can be performed wherein the evacuation operation control portion includes a device which determines whether or not fire-preventing doors at elevator landings on a fire occurrence floor have operated normally, as a condition for determining whether or not the evacuation operation can be performed.

2. The elevator control system according to claim 1, wherein the evacuation operation control portion has set therein a start condition for determining whether or not the evacuation operation can be started and a continuation condition for determining whether or not the evacuation operation can be continued, respectively.

3. The elevator control system according to claim 1, wherein the evacuation operation control portion determines whether or not the fire has been detected on all service floors, as a condition for determining whether or not the evacuation operation can be performed.

4. The elevator control system according to claim 1, wherein the evacuation operation control portion determines whether or not the fire has been detected as to corridors adjacent to elevator landings on all service floors, as a condition for determining whether or not the evacuation operation can be performed.

5. The elevator control system according to claim 1, wherein the evacuation operation control portion determines whether or not the fire has been detected in a machine room or a hoistway of the elevator, as a condition for determining whether or not the evacuation operation can be performed.

6. The elevator control system according to claim 1, wherein the evacuation operation control portion determines whether or not the fire has been detected on any one of a rescue floor and a floor immediately below the rescue floor, as a condition for determining whether or not the evacuation operation can be performed.

7. The elevator control system according to claim 1, wherein the evacuation operation control portion determines whether or not the fire has been detected in an electric installation in a building, as a condition for determining whether or not the evacuation operation can be performed.

8. The elevator control system according to claim 1, wherein the device which determines whether or not fire-preventing doors at an elevator landing on a fire occurrence floor further determines whether or not fire-preventing doors at an elevator landing of a floor immediately above the fire occurrence floor have operated normally, when determining whether or not the evacuation operation can be performed.

9. An elevator control system, comprising:

an evacuation operation control portion for determining, in an event of a fire, whether or not evacuation operation of the elevator can be performed based on information on the fire and an elevator, and outputting a command to perform the evacuation operation to an elevator control device when it is determined that the evacuation operation can be performed, wherein the evacuation operation control portion includes a device which determines whether or not fire emergency operation has been performed immediately after the occurrence of the fire, as a condition for determining whether or not the evacuation operation can be performed.

10. The elevator control system according to claim 1, wherein the evacuation operation control portion determines whether or not a pit of the elevator has been flooded, as a condition for determining whether or not the evacuation operation can be performed.

11. An elevator control system according to claim 9, wherein:

the fire emergency operation includes halting the elevator on the evacuation floor.

12. An elevator control system according to claim 9, wherein:

the fire emergency operation includes homing the elevator to the evacuation floor.

13. An elevator control system according to claim 11, wherein:

the fire emergency operation includes homing the elevator to the evacuation floor.

* * * * *

UNITED STATES PATENT AND TRADEMARK OFFICE

CERTIFICATE OF CORRECTION

PATENT NO. : 7,743,889 B2
APPLICATION NO. : 11/791018
DATED : June 29, 2010
INVENTOR(S) : Kawai It is certified that error appears in the above-identified patent and that said Letters Patent is hereby corrected as shown below:

On the title page, Item (86), the PCT should read:
-- (86) PCT No.: PCT/JP2006/300825

§371 (c) (1),
(2), (4) Date: May 18, 2007 --

Signed and Sealed this

Thirty-first Day of August, 2010

David J. Kappos

David J. Kappos
*Director of the United States Patent and Trademark Office*